United States Patent [19]

Nilssen

[11] Patent Number: 4,652,797

[45] Date of Patent: Mar. 24, 1987

[54] ELECTRONIC BALLAST WITH HIGH POWER FACTOR

[76] Inventor: Ole K. Nilssen, Caesar Dr., Barrington Hills, Ill. 60010

[21] Appl. No.: 693,367

[22] Filed: Jan. 22, 1985

[51] Int. Cl.[4] ..... H05B 37/02

[52] U.S. Cl. ..... 315/209 R; 315/246; 315/287; 315/307

[58] Field of Search ..... 315/246, 247, 224, 287, 315/242, 244, 127, 307, 310, DIG. 5, 106, 107; 363/55, 56

[56] References Cited

U.S. PATENT DOCUMENTS

| | | | |
|---|---|---|---|
| 4,045,711 | 8/1977 | Pitel | 315/DIG. 5 X |
| 4,109,307 | 8/1978 | Knoll | 315/247 X |
| 4,388,561 | 6/1983 | Koshimura et al. | 315/247 X |

FOREIGN PATENT DOCUMENTS

| | | | |
|---|---|---|---|
| 0048977 | 4/1982 | European Pat. Off. | 315/246 |
| 2458200 | 1/1981 | France | 315/106 |

*Primary Examiner*—David K. Moore

[57] ABSTRACT

A source of 120 Volt/60 Hz power line voltage is full-wave-rectified and yields an unfiltered DC voltage pulsed at 120 Hz rate. This pulsed DC voltage is applied to an inverter of a type that must be triggered into oscillation. At the beginning of each of the DC voltage pulses, the inverter is triggered into oscillation; and at the end of each of the DC voltage pulses, the inverter ceases to oscillate frm lack of adequate voltage to sustain oscillation.

The output of the inverter is a 30 kHz squarewave voltage amplitude modulated at the 120 Hz rate. Across the inverter output is connected a high-Q series L-C circuit resonant at about 30 kHz. A fluorescent lamp is connected in parallel with the tank capacitor of the L-C circuit.

With is high-Q resonant L-C circuit series-excited and parallel-loaded, the instantaneous magnitude of the current drawn by the inverter is substantially proportional to the instantaneous magnitude of the DC voltage provided; which implies that power is drawn from the power line with a relatively high power factor.

22 Claims, 2 Drawing Figures

ELECTRONIC BALLAST WITH HIGH POWER FACTOR

BACKGROUND OF THE INVENTION

1. Field of Invention

The present invention relates to power-line-operated electronic ballasts for gas discharge lamps, particularly of a type that draws power from the power line with relatively high power factor.

2. Prior Art

Power-line-operated electronic ballasts having high power factor have been previously described, such as in U.S. Pat. No. 4,277,726 to Burke. However, the methods normally used for achieving high power factor are complex and costly—typically requiring the use of a relatively large and heavy inductor means.

SUMMARY OF THE INVENTION

Objects of the Invention

An object of the present invention is that of providing a cost-effective power-line-operated high power factor ballast for a gas discharge lamp.

This as well as other important objects and advantages will become apparent from the following description.

Brief Description

A source of 120 Volt/60 Hz power line voltage is full-wave-rectified and yields an unfiltered DC voltage pulsed at 120 Hz rate. This pulsed DC voltage is applied to an inverter of a type that needs to be triggered into oscillation. At the beginning of each of the DC voltage pulses, the inverter is triggered into oscillation; and at the end of each of the DC voltage pulses, the inverter ceases to oscillate from lack of adequate voltage to sustain oscillation.

The output of the inverter is a 30 kHz squarewave voltage amplitude modulated at the 120 Hz rate. Across the inverter output is connected a high-Q series L-C circuit resonant at about 30 kHz. A fluorescent lamp is connected in parallel with the tank capacitor of the L-C circuit. A Varistor is connected in parallel with the fluorescent lamp.

With this high-Q resonant L-C circuit series-excited and parallel-loaded, the instantaneous magnitude of the current drawn by the inverter is substantially proportional to that of the DC voltage provided to the inerter; which implies that power is drawn from the power line with a relatively high power factor.

The Varistor is so chosen as to limit the magnitude of the voltage developing across the fluorescent lamp to a level suitable for proper starting of lamp with hot cathodes. After the lamp has started, current ceases to flow through the Varistor.

When power initially is applied to the inverter, the voltage across the lamp rises to a magnitude limited by the Varistor. However, if the lamp does not start within about 25 milli-seconds, which it normally will not do except when the cathodes are hot, an SCR operates to provide a short circuit across the tank capacitor. This short circuit will remain in effect for about 1.5 second, during which period the cathodes of the fluorescent lamp are provided with heating power. Thereafter, the short circuit is removed and the voltage across the lamp will rise to a magnitude suitable for proper lamp starting. Under normal circumstances, with hot cathodes, lamp starting will occur within about 25 milli-seconds.

If the lamp does not start within that time span, the short circut will be re-applied. Thereafter, until the lamp starts or power is removed, the short circuit will be periodically removed for about 25 milli-seconds every 1.5 second or so.

DESCRIPTION OF THE PREFERRED EMBODIMENT

Details of Construction

Figure 1:
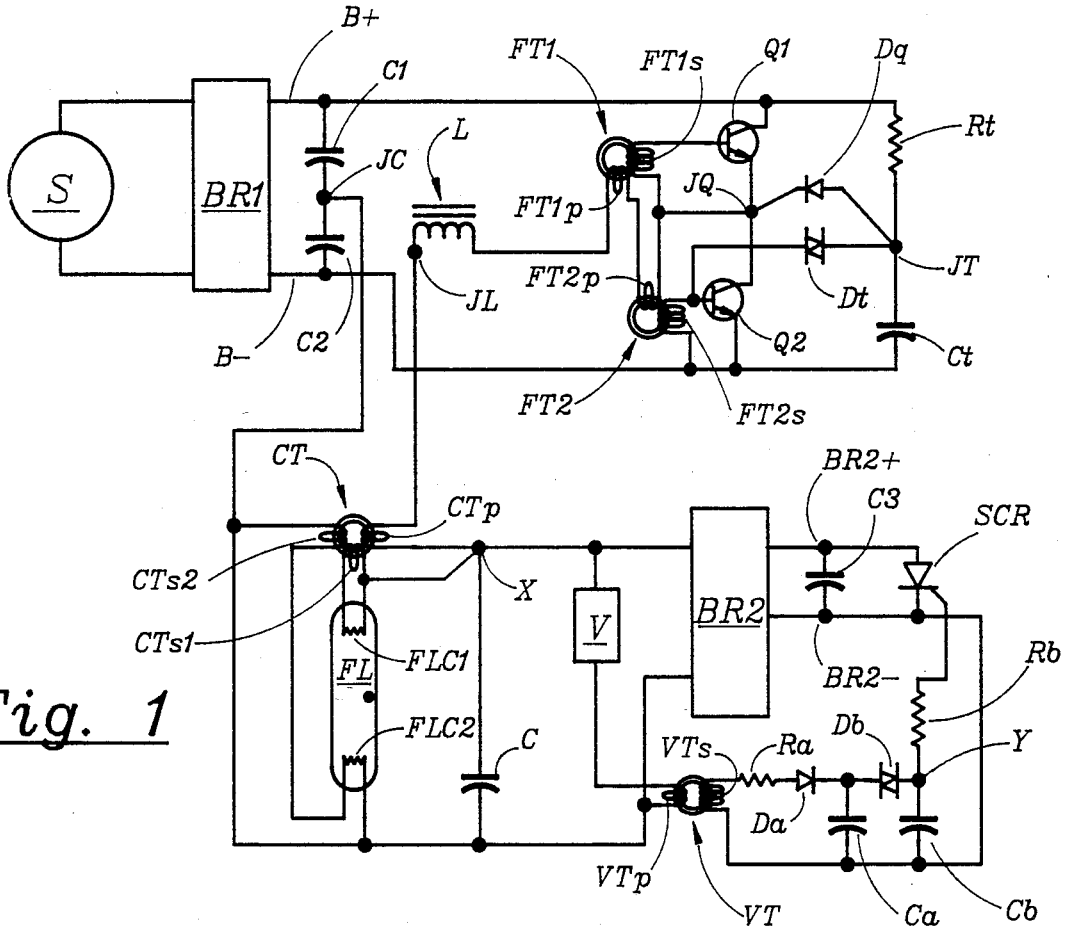
FIG. 1 provides a schematic circuit diagram of the preferred embodiment of the invention.

FIG. 1 shows an AC voltage source S, which in reality is an ordinary 120 Volt/60 Hz power line, connected to a bridge rectifier BR1. The DC voltage output from BR1 is applied between a B+ bus and a B− bus—with the B+ bus being of positive voltage relative to the B− bus.

A capacitor C1 is connected between the B+ bus and a junction JC; and a capacitor C2 is connected between junction JC and the B− bus.

The collector and the emitter of a transistor Q1 are connected with the B+ bus and a junction JQ, respectively; and the collector and the emitter of a transistor Q2 are connected with junction JQ and the B− bus, respectively.

A resistor Rt is connected between the B+ bus and a junction Jt; a capacitor Ct is connected between Jt and the B− bus; a Diac Dt is connected between Jt and the base of transistor Q2; and a diode Dq is connected with its cathode to junction JQ and with its anode to junction Jt.

An inductor L, the primary winding FT1*p* of a first feedback transformer FT1, and the primary winding FT2*p* of a second feedback transformer FT2 are all connected in series between a junction JL and junction JQ.

The secondary winding FT1*s* of transformer FT1 is connected between the base and emitter of transistor Q1; and the secondary winding FT2*s* of transformer FT2 is connected between the base and emitter of transistor Q2.

The primary winding CTp of cathode transformer CT is connected between junction JL and point X. A first secondary winding CTs1 of transformer CT is connected with the terminals of a first cathode FLC1 of a fluorescent lamp FL; and a second secondary winding CTs2 of transformer CT is connected with the terminals of a second cathode FLC2 of fluorescent lamp FL.

One of the terminals of cathode FLC1 is connected with point X; and one of the terminals of cathode FLC2 is connected with junction JC. A capacitor C is also connected between point X and junction JC, as are as well the input terminals of a bridge rectifier BR2.

A Varistor V is connected in series with the primary winding VTp of a transformer VT, and this series-combination is connected between point X and junction JC.

The DC output voltage of BR2 is provided between terminals BR2+ and BR2−, with the BR2+ terminal being of positive polarity in respect to the BR2− terminal. A capacitor C3 is connected between the BR2+ and the BR2− terminals. A thyristor SCR is connected with its anode to the BR2+ terminal and with its cathode to the BR2− terminal.

One side of secondary winding VTs of transformer VT is connected with the cathode of thyrister SCR. A resistor Ra is connected between the other side of secondary winding VTs and the anode of a diode Da. A capacitor Ca is connected between the cathode of diode Da and the cathode of thyristor SCR. A Diac Db is connected between the cathode of diode Da and a point Y; and a capacitor Cb is connected between point Y and the cathode of thyristor SCR. A resistor Rb is connected between point Y and the gate of thyristor SCR.

Details of Operation

Figure 2:
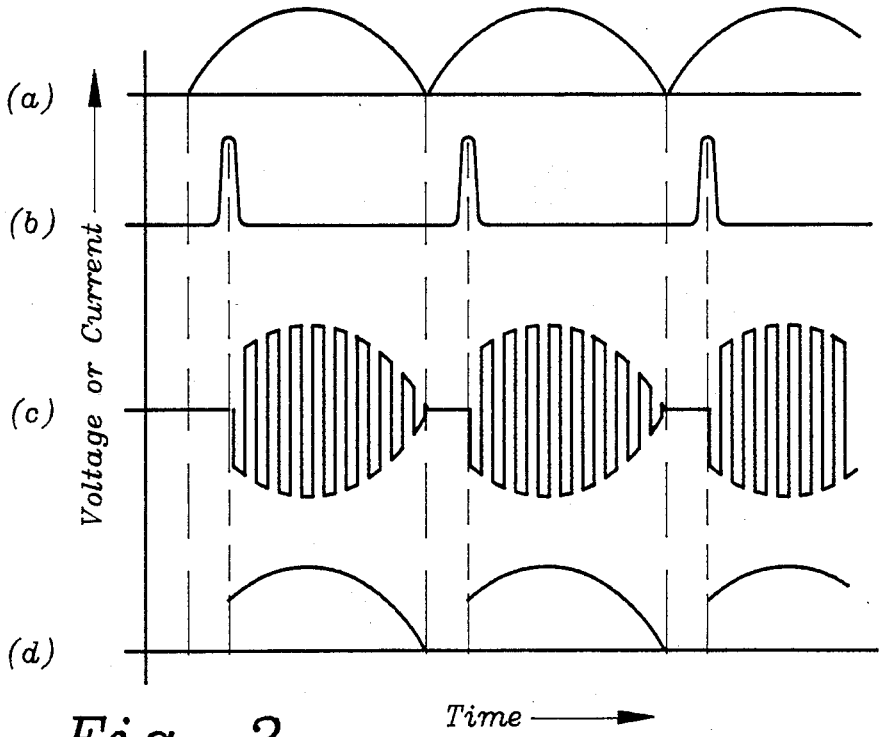
FIG. 2 illustrates various voltage and current waveforms associated with the circuit of FIG. 1.

In FIG. 1, as illustrated by FIG. 2*a*, the DC voltage between the B+ bus and the B− bus is an unfiltered full-wave-rectified 60 Hz power line voltage. This 120 Hz pulsed DC voltage is applied to the trigger circuit consisting of Rt, Ct, Dt and Dq; which trigger circuit provides a trigger pulse to the base of transistor Q2 in the beginning of each of the sinusoidally-shaped pulses of DC voltage—as illustrated in FIG. 2*b*.

When the pulsed DC voltage from bridge rectifier BR1 is applied across the inverter (which basically consists of capacitors C1 and C2, transistors Q1 and Q2, and feedback transformers FT1 and FT2), it starts to oscillate and to provide across its output terminals JQ and JC the amplitude-modulated 30 kHz squarewave voltage illustrated by FIG. 2*c*. Since the magnitude of the DC supply voltage falls to zero toward the end of each of the individual voltage pulses, the inverter actually stops oscillating near the end of each of these pulses. However, a trigger pulse is provided shortly after the onset of the next individual pulse, thereby providing for a net inverter output voltage similar to that depicted by FIG. 2*c*.

The purpose of diode D1 is that of preventing the continuous supply of trigger pulses after the inverter has started to oscillate.

Since the impedance of each of the two primary windings FT1*p* and FT2*p* of feedback transformers FT1 and FT2 is very small—both transformers being tiny saturable current transformers—the voltage depicted in FIG. 2*c* is in effect the voltage that is applied across the series-combination consisting of tank inductor L and the total assembly connected between junctions JL and JC. This total assembly includes primary winding CTp of transformer CT, which is a current transformer operative to provide cathode heating power to the fluorescent lamp cathodes. Primary winding CTp is of very small impedance compared with the other impedances in the total series-combination connected between junctions JQ and JC.

Tank capacitor C is connected between point X and junction JC; and L and C in combination are substantially series-resonant at the 30 kHz inverter frequency. Both L and C have relatively high Q factors; and, without considering external loading such as may be provided by the lamp and/or the Varistor, the magnitude of the voltage that would develop across C (assuming linear components and no break-down) would be more than 50 times as large as that of the voltage impressed across the L-C series circuit—which voltage is of approximately 60 Volt RMS magnitude.

However, even if the lamp were inoperative or non-connected, the Varistor—which is connected in series with the very low impedance primary winding VTp of current transformer VT—is chosen such that it will limit the magnitude of the voltage developing across C to a far lower level. In fact, the Varistor will limit the magnitude of the voltage developing across C to a level that is just right for proper lamp starting when the lamp cathodes are hot, yet quite inadequate to cause lamp starting when the lamp cathodes are cold.

When the voltage of FIG. 2*c* is initially applied to the L-C series-resonant circuit, the fluorescent lamp cathodes are cold and the magnitude of the voltage developing across C will be limited by the Varistor to a level too low to cause the lamp to ignite. The current flowing through the Varistor will be sensed bycurrent transformer Vt; and, by way of resistor Ra and diode Da, this Varistor current will cause capacitor Ca to charge up. Component values are chosen that it will take about 25 milli-seconds for Ca to reach a voltage of such magnitude (about 30 Volt) as to cause Diac Db to break down. The break-down of Diac Db will cause charge from capacitor Ca to flow into capacitor Cb, wherefrom current will then flow through resistor Rb and into the gate of Thyristor SCR, thereby causing SCR to switch into a conducting mode.

With thyristor SCR conducting, an effective short circuit is provided across capacitor C, and the voltage across the Varistor falls to near zero magnitude. Thus, current ceases to flow through the Varistor, and thereby ceases as well to cause charging of capacitor Ca. However, the charge that was placed onto capacitor Cb from capacitor Ca, as a result of the breakdown of Diac Db, will linger until it is dissipated by leakage through resistor Rb. Component values have been so chosen that current adequate to keep the (sensitive-gate) thyristor triggered flows into its gate terminal for a period of about 1.5 second; whereafter the gate current ceases to be sufficient to cause thyristor triggering.

Thus, after having constituted a short circuit across capacitor C for about 1.5 second, the thyristor will cease to conduct, and the voltage across capacitor C is free to rise to the magnitude permitted by the Varistor. However, by now the lamp cathodes are hot, and the fluorescent lamp will ignite within a period shorter than 25 milli-seconds. After the lamp has ignited, the voltage across the capacitor will be limited by the lamp impedance to a magnitude well below the point at which the Varistor conducts.

If the lamp should fall to ignite, be it due to malfunction of non-connection, the current flowing through the Varistor will again after about 25 milli-seconds cause capacitor Ca to charge up to the point of breakdown of Diac Db. Thereafter, as long as the lamp keeps failing to ignite, the thyristor circuit will provide for 1.5 second periods of short circuit alternating with 25 milli-second periods of open circuit.

As soon as an operable fluorescent lamp is connected, however, this cycling stops in that the lamp will normally ignite after being subjected to but one 1.5 second period of short circuit followed by a 25 milli-second period of open circuit.

Comments

The lamp cathodes are heated from the current flowing between the inverter's output terminals JQ and JC. This current flows whether or not the thyristor provides a short circuit across C. However, to improve luminous efficacy by removing cathode heating after lamp ignition, it is only necessary to move the primary winding CTc from its present position and place it instead in series with one of the input terminals to BR2.

However, this improved luminous efficacy would be achieved at the cost of somewhat reduced lamp life.

The nature of a fluorescent lamp is that of exhibiting a substantially constant voltage over a wide range of lamp currents. As a consequence of that fact, combined with operating the lamp as a parallel-connected load in a series-excited L-C resonant circuit, the current drawn from the inverter by the total load circuit will be approximately proportional to the magnitude of the exciting voltage. Thus, the current drawn by the inverter from its sinusoidally pulsed DC voltage supply will be as indicated by FIG. 2*d;* which indicates that the power drawn from the power line will be nearly sinusoidal, and therefore provide for an excellent power factor.

It is noted that the phasing of the trigger pulse of FIG. 2*b* can readily be arranged such as to cause the inverter to initiate oscillations just a few degrees into the sinusoidally-shaped DC voltage pulse.

It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. A ballasting means for a gas discharge lamp, comprising:

a source of DC voltage having an instantaneous magnitude alternating at a relatively low frequency between being higher and lower than a certain level;

inverter means connected with said source of DC voltage and operable to provide an AC voltage output of relatively high frequency, said AC voltage output having an instantaneous peak amplitude that is substantially proportional to the instantaneous absolute magnitude of said DC voltage whenever the magnitude of this DC voltage exceeds said certain level, said AC voltage output being interrupted at said relatively low frequency with discrete periods during which its amplitude is of substantially zero magnitude, these periods occurring whenever the magnitude of said DC voltage is lower than said certain level;

an L-C circuit connected with said AC voltage output, said L-C circuit being resonant at or near said relatively high frequency; and means for connecting said gas discharge lamp with said L-C circuit;

whereby AC voltage provided to the gas discharge lamp is discretely interrupted on a periodic basis at a relatively low frequency, thereby permitting improved control of the ballasting of said gas discharge lamp.

2. The ballasting means of claim 1 wherein said L-C circuit is series-connected across said AC output and comprises an inductor and a capacitor, and wherein said gas discharge lamp is connected in parallel-circuit with said capacitor.

3. The ballasting means of claim 2 wherein the Q-factor of said L-C circuit is at least 50.

4. The ballasting means of claim 2 comprising voltage-limiting means connected in parallel-circuit with said capacitor.

5. The ballasting means of claim 2 comprising means for providing an effective short circuit across said capacitor in case said lamp fails to ignite within a relatively brief period.

6. The ballasting means of claim 5 wherein said relatively brief period is on the order of 25milli-seconds or less.

7. The ballasting means of claim 1 wherein the magnitude of said DC voltage remains above said certain level for a larger part of the time than it remains below said certain level.

8. The ballasting means of claim 1 wherein said relatively low frequency is not so low as to cause substantial visible flicker of the light generated by said gas discharge lamp.

9. A ballasting means for a gas discharge lamp, said ballasting means being adapted to be powered from an ordinary electric utility power line and comprising:

rectifier means connected with said power line and operable to provide an output of DC voltage having an instantaaneous magnitude alternating at a relatively low frequency between being higher and lower than a certain level;

inverter means connected with said DC voltage and operable to provide an AC voltage output of relatively high frequency, said AC voltage output having an instantaneous peak amplitude that is substantially proportional to the instantaneous absolute magnitude of said DC voltage whenever the magnitude of this DC voltage exceeds said certain level, said AC voltage output being interrupted at said relatively low frequency with discrete periods during which its amplitude is of substantially zero magnitude, these periods occurring whenever the magnitude of said DC voltage is lower than said certain level; and coupling circuit connected with said AC voltage output and operable to provide connection and matching between said AC voltage output and said gas discharge lamp;

whereby AC voltage provided to the gas discharge lamp is discretely interrupted on a periodic basis at a relatively low frequency, thereby permitting improved control of the ballasting of said gas discharge lamp.

10. The ballasting means of claim 9 wherein said relatively low frequency is twice the frequency of the voltage on said power line.

11. The ballasting means of claim 9 wherein said coupling circuit comprises an L-C circuit that is series-excited by said AC voltage output and parallel-loaded by said gas discharge lamp.

12. The ballasting means of claim 11 wherein said L-C circuit comprises a capacitor and wherein said lamp is connected in parallel with said capacitor.

13. The ballasting means of claim 12 and means operative to provide an effective short circuit across said capacitor in case said gas discharge lamp fails to operate for but a brief period of time.

14. The ballasting means of claim 13 and means whereby said short circuit is removed periodically for a short period of time until said lamp starts, said short period of time being approximately equal to said brief period of time.

15. The ballasting means of claim 14 wherein said brief period of time is of approximately 25 milli-seconds duration.

16. The ballasting means of claim 12 wherein said short circuit is provided for a time interval of about one second, after which time interval the short circuit is removed.

17. The ballasting means of claim 11 wherein said L-C circuit comprises a high-Q inductor and a high-Q capacitor, thereby causing the magnitude of the current drawn by the inverter means from said DC voltage to be approximately proportional to the instantaneous magnitude of this DC voltage.

18. A ballast for a gas discharge lamp, said ballast being adapted to be powered from the relatively low frequency voltage on a regular electric utility power line and comprising:

rectifier means connected with said power line and operative to provide a DC supply voltage, said DC supply voltage being characterized by having an instantaneous unidirectional magnitude that is substantially equal to the instantaneous absolute magnitude of said low frequency voltage, whereby said instantaneous unidirectional magnitude increases above a certain threshold level once for each half-cycle of said relatively low frequency and decreases below said threshold level once for each half-cycle of said relatively low frequency voltage;

inverter connected with said DC supply voltage and operative to provide a relatively high frequency output voltage, said inverter characterized by: (i) ceasing operation each time the instantaneous magnitude of said DC supply voltage decreases below said certain threshold level, (ii) resuming operation each time after the instantaneous magnitude of said DC supply voltage has increased above said certain threshold level, but only if it is provided with a trigger pulse;

trigger means connected in circuit with said DC supply voltage and operable to provide said trigger signal to said inverter some pre-selected time-period after each time the magnitude of said DC supply voltage has increased above said certain threshold level, the duration of said pre-selected time-period being less than that of the half-period of said relatively low frequency voltage; and coupling circuit connected with said high frequency output voltage and operable to provide connection and impedance matching between said high frequency output voltage and said gas discharge lamp.

19. The ballast of claim 18 wherein said coupling circuit comprises an L-C circuit that is series-excited by said high frequency output voltage and parallel-loaded by said gas discharge lamp, said L-C circuit being resonant at or near the frequency of said high frequency output voltage.

20. The ballast of claim 19 wherein: (i) said L-C circuit comprises an inductor and a capacitor, (ii) said gas discharge lamp is effectively connected in parallel with said capacitor, and (iii) a shorting means is operative to provide an effective short circuit across said capacitor whenever said lamp fails to start within a brief period, said brief period being longer than said pre-selected time-period.

21. A ballast for a gas discharge lamp, said ballast: (i) being adapted to be powered from the relatively low frequency voltage on an oridinary electric utility power line, (ii) being operable to power said gas discharge lamp with a relatively high frequency output voltage, and (iii) comprising:

rectifier means connected with said power line and operable to provide a non-filtered DC supply voltage;

inverter connected with said DC supply voltage and operative when oscillating to provide said output voltage, said inverter characterized by: (i) ceasing oscillation whenever the magnitude of said DC supply voltage decreases below a certain minimum level, and (ii) resuming oscillation only after the magnitude of said DC supply voltage has increased above said certain minimum level, but only after having received a trigger pulse;

trigger means connected in circuit with said inverter and operative to provide said trigger pulse a pre-selected brief time-period after the magnitude of said DC supply voltage has increased above said certaon minimum level, said time-period being shorter than the period of said line voltage; and coupling means connected with said output voltage and operable to provide connection and impedance matching between said output voltage and said gas discharge lamp.

22. A ballast for a gas dicharge lamp, said ballast: (i) being adapted to be powered from the relatively low frequency voltage on an ordinary electric utility power line, (ii) being operable to power said gas discharge lamp with a relatively high frequency output voltage, and (iii) comprising:

rectifier means connected with said power line and operable to provide a non-filtered DC supply voltage;

inverter connected with said DC supply voltage and operative when oscillating to provide said output voltage, said inverter characterized by: (i) ceasing oscillation whenever the magnitude of said DC supply voltage decreases below a certain minimum level, and (ii) resuming oscillation only after the magnitude of said DC supply voltage has increased above said certain minimum level;

a series-combination of an inductor and a capacitor connected with said output voltage, said series-combination being resonant at or near the frequency of said output voltage; and coupling means operable to permit connection of said gas discharge lamp in effective parallel-circuit with said capacitor.

* * * * *